US010718288B2

(12) United States Patent
Moritsugu et al.

(10) Patent No.: US 10,718,288 B2
(45) Date of Patent: Jul. 21, 2020

(54) FAILURE DIAGNOSIS DEVICE FOR IGNITION CIRCUIT

(71) Applicant: DENSO CORPORATION, Kariya, Aichi-pref. (JP)

(72) Inventors: Michiyasu Moritsugu, Nisshin (JP); Shunichi Takeda, Kariya (JP)

(73) Assignee: DENSO CORPORATION, Kariya (JP)

( * ) Notice: Subject to any disclaimer, the term of this patent is extended or adjusted under 35 U.S.C. 154(b) by 156 days.

(21) Appl. No.: 16/080,436

(22) PCT Filed: Feb. 13, 2017

(86) PCT No.: PCT/JP2017/005188
§ 371 (c)(1),
(2) Date: Aug. 28, 2018

(87) PCT Pub. No.: WO2017/150164
PCT Pub. Date: Sep. 8, 2017

(65) Prior Publication Data

US 2019/0078528 A1 Mar. 14, 2019

(30) Foreign Application Priority Data

Feb. 29, 2016 (JP) ..... 2016-037546

(51) Int. Cl.
*F02D 41/22* (2006.01)
*F02P 1/08* (2006.01)
(Continued)

(52) U.S. Cl.
CPC ..... *F02D 41/221* (2013.01); *F02P 1/083* (2013.01); *F02P 1/086* (2013.01); *F02P 3/01* (2013.01); *F02P 17/00* (2013.01); *F02P 11/06* (2013.01)

(58) Field of Classification Search
CPC . F02D 41/221; F02P 3/01; F02P 17/00; F02P 17/12; F02P 1/086; F02P 1/083; F02P 11/06
See application file for complete search history.

(56) References Cited

U.S. PATENT DOCUMENTS 5,623,209 A * 4/1997 Lepley ..... F02P 17/12 324/379
6,675,784 B2 * 1/2004 Nagase ..... F02P 3/051 123/603

(Continued)

FOREIGN PATENT DOCUMENTS

JP 2003-028037 1/2003

*Primary Examiner* — David Hamaoui
(74) *Attorney, Agent, or Firm* — Nixon & Vanderhye P.C.

(57) ABSTRACT

A failure diagnosis device for an ignition circuit, comprising: an ignition plug; an ignition coil; a capacitor series connection including a high side capacitor and a low side capacitor; a switching-element series connection including a high side switching element and a low side switching element; an inter-terminal voltage detection unit for detecting an inter-terminal voltage of the capacitor series connection; an intermediate voltage detection unit for detecting an intermediate voltage at the connection point of the high side capacitor and the low side capacitor; and a determination unit for determining a failure location of the ignition circuit based on at least one of the inter-terminal voltage and the intermediate voltage.

20 Claims, 5 Drawing Sheets

(51) Int. Cl.

| | |
|---|---|
| ***F02P 17/00*** | (2006.01) |
| ***F02P 3/01*** | (2006.01) |
| *F02P 11/06* | (2006.01) |

(56) References Cited

U.S. PATENT DOCUMENTS 9,590,515 B2 * 3/2017 Uchihara ..... H02M 3/33561
9,995,267 B2 * 6/2018 Kondou ..... F02P 3/0435

* cited by examiner

FAILURE DIAGNOSIS DEVICE FOR IGNITION CIRCUIT

CROSS-REFERENCE TO RELATED APPLICATION

This application is a U.S. National Phase Application under 35 U.S.C. 371 of International Application No. PCT/JP2017/005188 filed on Feb. 13, 2017 and published in Japanese as WO2017/150164 on Sep. 8$^{th}$, 2017. This application is based on and claims the benefit of priority from Japanese Patent Application No. 2016-037546 filed on Feb.29$^{th}$, 2016. The entire disclosures of all of the above applications are incorporated herein by reference.

TECHNICAL FIELD

The present disclosure relates to a failure diagnosis device for an ignition circuit of an engine.

BACKGROUND ART

In recent years, in order to improve the fuel economy of an automotive internal combustion engine, studies are being conducted on techniques related to lean burn control (lean burn engines) or EGR which returns combustion gas to the cylinder of the internal combustion engine. In these techniques, various ignition systems for effectively burning the fuel included in the air-fuel mixture have been proposed, such as the multiple ignition scheme in which the ignition plug generates discharge a plurality of times consecutively at the ignition timing of the internal combustion engine, and the DCO scheme in which the ignition plug generates discharge continuously for a fixed period of time which is close to the ignition timing. In these ignition devices, for example, when a short failure or an open failure occurs in the ignition coil, it becomes difficult for the spark plug to generate a spark discharge.

The ignition device that performs multiple ignition described in PTL 1 comprises a capacitor, and the electric energy stored in the capacitor is supplied to the ignition coil by turning on a switching means called a second switching means. A large secondary current flows through the secondary coil due to the inrush current at this time, and spark discharge is generated at the spark plug. Then, the switching means is turned off, a large secondary current flows through the secondary coil, and spark discharge is generated at the spark plug. It is described that, according to such an ignition device, any failure in the ignition device can be monitored by reading the current flowing through the switching means.

CITATION LIST

Patent Literature

[PTL 1] JP 2003-28037 A

SUMMARY OF THE INVENTION

The technique described in PTL 1 is directed to an ignition device having one capacitor. However, it does not mention the case of diagnosing failure in an ignition device in which two capacitors are connected in series and two switch means are provided to individually control the release timing of the electric energy stored in each capacitor. Regarding this ignition device, if failure diagnosis of the ignition device is to be carried out by detecting the current flowing through the switching means, since two switching means are provided in the ignition device, two current value monitoring means for monitoring the current flowing through the switching means must be provided. In such case, the current value monitoring means of the switching means provided on the high side requires a complicated configuration as compared with a conventional current value monitoring means.

The present disclosure has been made to solve the above problems, and its main object is to provide a failure diagnosis device for an ignition circuit capable of determining the failure location of the ignition circuit in an ignition circuit in which two capacitors are connected in series, and allows simplification of the ignition circuit.

The present disclosure relates to a failure diagnosis device for an ignition circuit, comprising: an ignition plug for generating discharge to ignite a combustible fuel-air mixture; an ignition coil including a primary coil and a secondary coil, the ignition coil causing the ignition plug connected to the secondary coil to generate the discharge by voltage induction of the primary coil; a capacitor series connection including a high side capacitor connected to a charge supply unit, and a low side capacitor connected in series to the high side capacitor; a switching-element series connection including a high side switching element and a low side switching element, the switching-element series connection being connected in parallel with the capacitor series connection, a connection point of the high side switching element and the low side switching element being connected to a connection point of the high side capacitor and the low side capacitor via the primary coil, and the high side switching element and the low side switching element being configured to complementarily open and close; an inter-terminal voltage detection unit for detecting an inter-terminal voltage of the capacitor series connection; an intermediate voltage detection unit for detecting an intermediate voltage which is a voltage at the connection point of the high side capacitor and the low side capacitor; and a determination unit for determining a failure location of the ignition circuit based on at least one of the inter-terminal voltage detected by the inter-terminal voltage detection unit and the intermediate voltage detected by the intermediate voltage detection unit.

In this ignition circuit, the high side switching element and the low side switching element complementarily open and close, whereby the primary current is supplied complementarily from the high side capacitor and the low side capacitor to the primary coil. Since the primary current supplied from each of the capacitors to the primary coil is conducted and interrupted, an induced voltage is generated in the secondary coil, resulting in the ignition plug to generate a discharge a plurality of times. When one of the components necessary for causing the ignition plug to generate discharge fails, it becomes difficult to cause the ignition plug to generate discharge, and the determination unit determines the failure location of the ignition circuit.

In this ignition circuit, the primary current flowing through the primary coil when generating discharge at the ignition plug originates from the high side capacitor or the low side capacitor. Therefore, when any of the components necessary for causing the spark plug to generate discharge fails, it can be considered that the inter-terminal voltage of the capacitor series connection including the high side capacitor and the low side capacitor or the intermediate voltage which is the voltage at the connection point of the high side capacitor and the low side capacitor has a fluctuation that is different from that of when the ignition circuit is normal. The fluctuation which the inter-terminal voltage or the intermediate voltage would have depending on the location of the failure can be predicted in advance. Thus, the present determination unit can determine the fault location of the ignition circuit based on at least one of the inter-terminal voltage and the intermediate voltage. Further, it is possible to simplify the ignition circuit as compared with a device that performs failure determination of the ignition circuit based on the currents flowing through the high side switching element and the low side switching element.

BRIEF DESCRIPTION OF THE DRAWINGS

The above and other objects, features, and advantages of the present disclosure will become clearer from the following detailed description with reference to the accompanying drawings. In the drawings.

DESCRIPTION OF THE EMBODIMENTS

Figure 1:
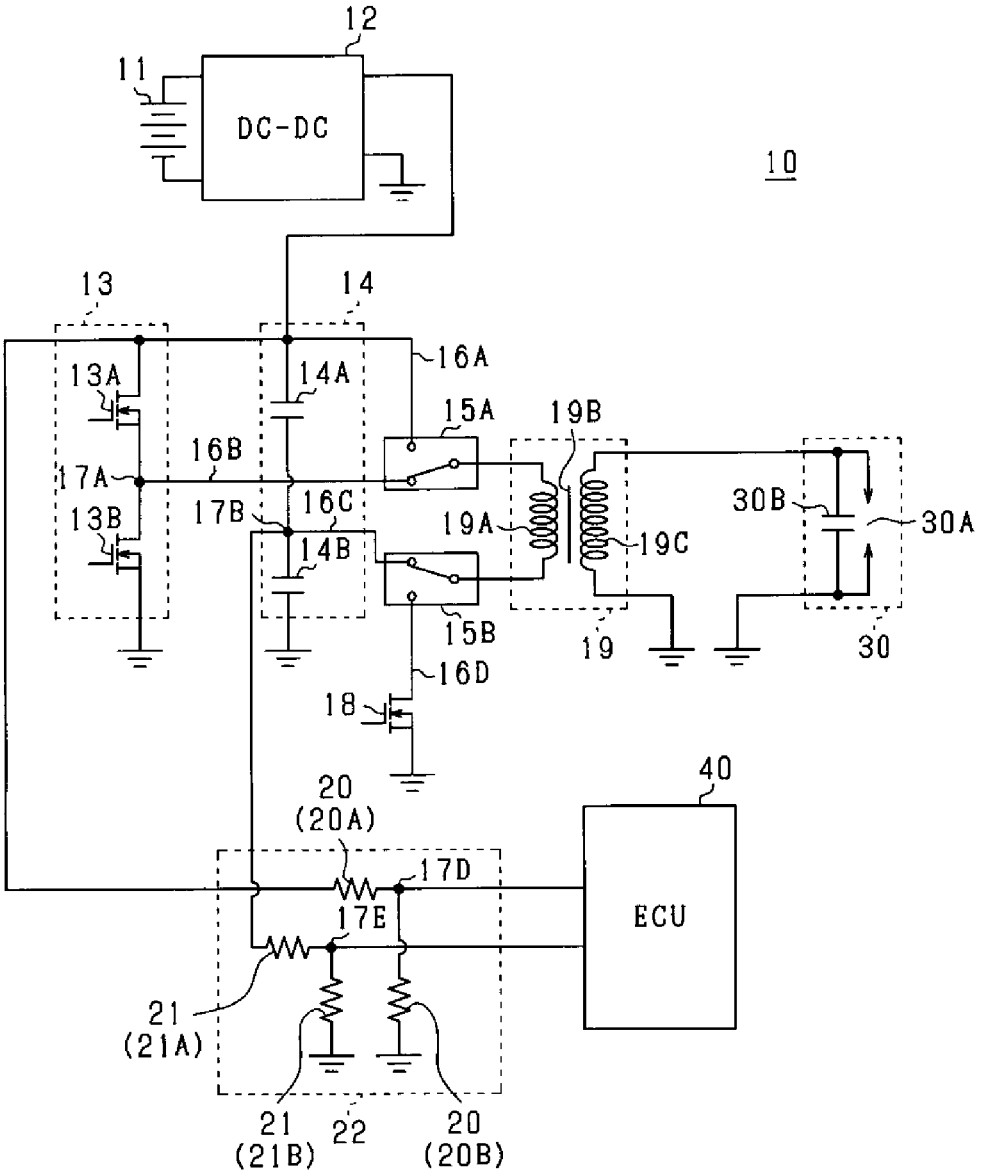
FIG. 1 is a schematic configuration diagram of an ignition circuit according to a first embodiment.

The present embodiment will be described with reference to the drawings. An ignition circuit 10 for an internal combustion engine shown in FIG. 1 comprises one ignition coil 19, a MOSFET series connection 13 including two MOSFETs 13A and 13B connected in series, a capacitor series connection 14 including two capacitors 14A and 14B connected in series, an ignition plug 30, a DC-DC converter 12 (corresponding to the charge supply unit), a voltage detection circuit 22, two relays 15A and 15B, and a MOSFET 18 (corresponding to the third switching element).

A battery 11 and the DC-DC converter 12 are connected in series. In the present embodiment, the battery 11 is configured by connecting a plurality of secondary batteries in series. A predetermined voltage is applied from the battery 11 to the DC-DC converter 12, and the DC-DC converter 12 boosts the voltage based on the applied voltage.

The output side of the DC-DC converter 12 is branched and the branches are respectively connected to the MOSFET series connection 13, the capacitor series connection 14, the voltage detection circuit 22, and a current path 16A connected to the relay 15A (corresponding to the first path switching unit).

The first end of the capacitor 14A (corresponding to a high side capacitor) of the capacitor series connection 14 located on a high side is connected to the output side of the DC-DC converter 12, and the second end of the capacitor 14A is connected to a first end of the capacitor 14B (corresponding to the low side capacitor). The second end of the capacitor 14B is connected to the ground. A current path 16C connected to the relay 15B (corresponding to a second path switching unit) branches from a connection point 17B of the capacitor 14A and the capacitor 14B. A current path connected to the voltage detection circuit 22 branches from a connection point 17B of the capacitor 14A and the capacitor 14B. In the present embodiment, the capacitance of the capacitor 14A is designed to be equal to the capacitance of the capacitor 14B.

The MOSFET series connection 13 is connected in parallel with the capacitor series connection 14. The drain terminal of the MOSFET 13A (corresponding to the high side switching element) located on the high side of the MOSFET series connection 13 is connected to the output side of the DC-DC converter 12, and the source terminal of the MOSFET 13A is connected to the drain terminal of the MOSFET 13B (corresponding to the low side switching element). The source terminal of the MOSFET 13B is connected to the ground. A current path 16B connected to the relay 15A branches from a connection point 17A of the MOSFET 13A and the MOSFET 13B.

The relay 15A is always connected to the first end of a primary coil 19A, and is provided so as to enable switching between connection with the current path 16A and connection with the current path 1613. The relay 15B is always connected to the second end of the primary coil 19A, and is provided so as to enable switching between connection with the current path 16C and connection with the current path 16D described later. The current path 16D is a current path having the MOSFET 18. The drain terminal of the MOSFET 18 is connected to the relay 15B, and the source terminal of the MOSFET 18 is connected to the ground.

The ignition coil 19 has a secondary coil 19C and an iron core 19B in addition to the primary coil 19A. The first end of the primary coil 19A is connected to the relay 15A, and the second end of the primary coil 19A is connected to the relay 15B. On the other hand, the first end of the secondary coil 19C is connected to the ground via the ignition plug 30, and the second end of the secondary coil 19C is connected to the ground.

The ignition plug 30 is provided with opposing electrodes 30A, and also a stray capacitance 30B is illustrated. The stray capacitance 30B is a capacitance component formed by the opposing electrodes 30A, an insulator surrounding the opposing electrodes 30A, and the ground. The opposing electrodes 30A and the stray capacitance 30B are connected in parallel.

The voltage detection circuit 22 comprises a voltage divider including a current path having a resistor series connection 20 in which two resistors are connected in series and a current path having a resistor series connection 21 in which two resistors are connected in series.

The first end of the resistor 20A of the resistor series connection 20 located on the high side is connected to the output side of the DC-DC converter 12, and the second end of the resistor 20A is connected to the first end of the resistor 20B. The second end of the resistor 20B is connected to the ground. The first end of the resistor 21A of the resistor series connection 21 located on the high side is connected to the connection point 17B, and the second end of the resistor 21A is connected to the first end of the resistor 21B. The second end of the resistor 21B is connected to the ground. The connection point 17D of the resistor 20A and the resistor 20B, and the connection point 17E of the resistor 21A and the resistor 21B are connected to an electronic control unit (ECU) 40.

The voltage detection circuit 22 having such a configuration sends a voltage detection signal to the ECU 40 (corresponding to the determination unit) regarding the voltage (divided voltage) of the connection point 17D of the resistor series connection 20 as the voltage Vin across (hereinafter also referred to as the inter-terminal voltage) the capacitor series connection 14. Further, it sends a voltage detection signal to the ECU 40 regarding the divided voltage of the connection point 17E of the resistor series connection 21 as the intermediate voltage V½, which is the voltage of the connection point 17B of the capacitors 14A and 14B. Therefore, the voltage detection circuit 22 corresponds to the inter-terminal voltage detection unit and the intermediate voltage detection unit.

The ECU 40 sends a control signal to the relays 15A and 15B in the case where the ignition circuit 10 is in a normal state (in the case where it is determined that there is no failure in the configuration necessary for causing the spark plug 30 to generate discharge as described later). As a result, the relay 15A connects the current path 16B with the first end of the primary coil 19A and cuts off the connection between the current path 16A and the first end of the primary coil 19A. The relay 15B connects the current path 16C with the second end of the primary coil 19A and cuts off the connection between the current path 16D and the second end of the primary coil 19A. That is, the connection point 17A of the MOSFET 13A and the MOSFET 13B is connected to the connection point 17B of the capacitor 14A and the capacitor 14B via the relay 15A, the primary coil 19A, and the relay 15B.

Under this condition, the ECU 40 sends an open/close signal to the MOSFETs 13A and 13B so that the MOSFETs 13A and 13B are complementarily opened and closed. At this time, the frequency of the opening/closing signal sent to the MOSFETs 13A and 13B is adjusted to a frequency (resonance frequency) that causes voltage resonance between the stray capacitance 30B of the spark plug 30 and the secondary coil 19C. Since the MOSFETs 13A and 13B that have received the open/close signal complementarily open and close, the primary current supplied from the capacitors 14A and 14B to the primary coil 19A is conducted and interrupted, and an induced voltage is generated in the secondary coil 19C, resulting in the spark plug 30 to generate discharge a plurality of times.

According to such an ignition circuit 10, when one of the components necessary for causing the spark plug 30 to generate discharge, specifically, the MOSFETs 13A and 13B, the capacitors 14A and 14B, and the primary coil 19A, fails, it becomes difficult to cause the spark plug 30 to generate discharge.

Conventionally, when carrying out failure diagnosis of an ignition circuit, the failure diagnosis is performed based on the magnitude of the current flowing through the switching element which controls the conduction and interruption of the primary current flowing through the primary coil 19A. Similarly to the prior art, a case is assumed for the ignition circuit of the present embodiment where a fault in the ignition circuit 10 is diagnosed by detecting the currents flowing through the MOSFETs 13A and 13B corresponding to the switching elements. In this case, it is necessary to detect each of the currents flowing through the MOSFET 13A and the MOSFET 13B. In particular, the current value measuring unit of the MOSFET 13A provided on the high side requires a complicated configuration as compared with the conventional current value measuring unit.

In the ignition circuit 10, the primary current flowing through the primary coil 19A when generating discharge at the spark plug 30 originates from the capacitor 14A or the capacitor 14B. Therefore, when any of the above described configurations necessary for causing the spark plug 30 to generate discharge fails, it can be considered that the inter-terminal voltage Vin or the intermediate voltage V½ detected by the voltage detection circuit 22 has a fluctuation that is different from that of when the ignition circuit 10 is normal. The fluctuation which the inter-terminal voltage Vin or the intermediate voltage V½ would have depending on the location of the failure can be predicted in advance. Therefore, the ECU 40 according to the present embodiment determines the fault location of the ignition circuit 10 based on at least one of the inter-terminal voltage Vin and the intermediate voltage V½. With such a configuration, it is possible to simplify the ignition circuit 10 as compared with a device that performs failure determination of the ignition circuit 10 based on the currents flowing through the MOSFET 13A and the MOSFET 13B.

In the present embodiment, ignition control is appropriately changed according to the failure location after the failure location is determined.

When it is determined that the primary coil 19A is faulty, no charge can be stored in the primary coil 19A, and it is difficult to generate an induced voltage at the secondary coil 19C. In this case, the use of the cylinder having the corresponding ignition circuit 10 is stopped, and the driving of the engine is continued using only the normal cylinders (hereinafter referred to as reduced cylinder operation).

Further, when it is determined that there is a failure where one of the MOSFETs 13A and 13B cannot be shifted from the open state to the closed state (hereinafter referred to as open failure), the one normal MOSFET is used to cause the ignition plug 30 to generate discharge. For example, when an open failure occurs in the MOSFET 13B, only the normal MOSFET 13A is open/close driven to control the conduction and interruption of the primary current from the capacitor 14A to the primary coil 19A. As a result, an induced voltage is generated in the secondary coil 19C, and the spark plug 30 generates discharge. This control is referred to as full transistor ignition operation (full transistor operation).

When it is determined that another failure, for example, a failure where the MOSFET 13A cannot shift from the closed state to the open state (hereinafter referred to as short failure) has occurred, the spark plug 30 is caused to generate discharge by a full transistor operation using the MOSFET 18. Specifically, controls signals are sent to the relays 15A and 15B, and the relay 15A connects the current path 16A with the first end of the primary coil 19A and cuts off the connection between the current path 16B and the first end of the primary coil 19A. The relay 15B connects the current path 16D with the second end of the primary coil 19A and cuts off the connection between the current path 16C and the second end of the primary coil 19A. (Formation of emergency circuit). That is, a current path including the fault location is not used, and a current path that supplies current directly from the DC-DC converter 12 to the primary coil 19A via the relay 15A is constructed, and the MOSFET 18 of the current path 16D controls the conduction and interruption of the primary current to the primary coil 19A. In the emergency circuit, the spark plug 30 is caused to generate discharge by performing a full transistor operation in which the conduction and interruption of the primary current to the primary coil 19A is controlled by driving the MOSFET 18 to open and close.

Figure 2:
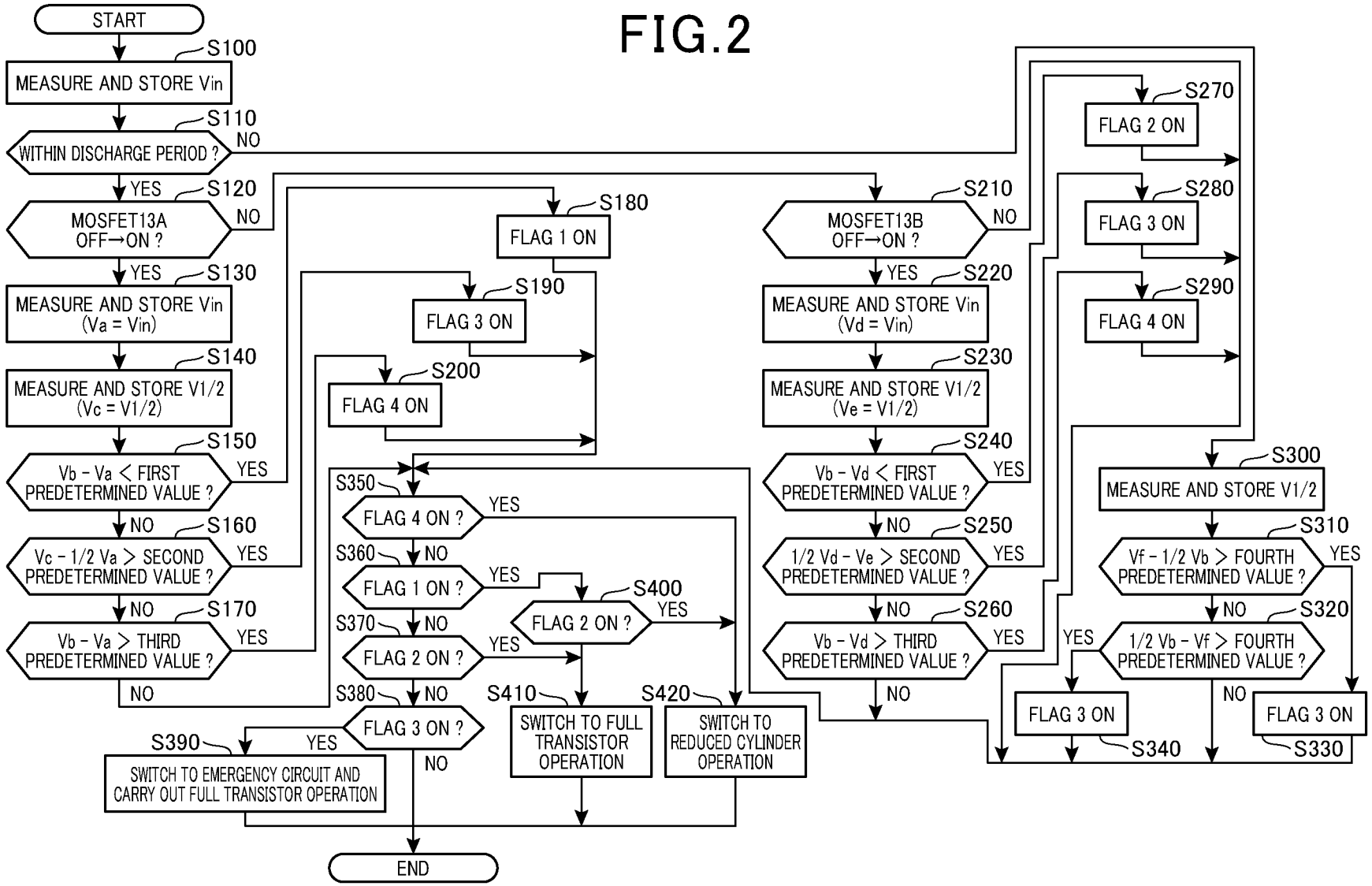
FIG. 2 is a flowchart of a failure determination and countermeasure process performed by the ECU according to the first embodiment.

In the present embodiment, the ECU 40 executes failure determination and a countermeasure process of the ignition circuit 10 shown in FIG. 2 and described later. The failure determination and the countermeasure process of the ignition circuit 10 shown in FIG. 2 are repeatedly executed at predetermined cycles by the ECU 40 while the ECU 40 is powered on.

When this process is started, first, in step S100, the voltage detection circuit 22 measures the inter-terminal voltage Vin and stores the value as the voltage Vb. Then, in step S110, it is determined whether or not the current point of time is within a period (discharge period) in which the spark plug 30 is caused to generate discharge in the combustion cycle. When it is determined that the present time is within the discharge period (S110: YES), the process proceeds to step S120.

In step S120, it is determined whether or not a signal for shifting the MOSFET 13A from the open state (OFF state) to the closed state (ON state) is sent to the MOSFET 13A. When it is determined that a signal for shifting the MOSFET 13A from the open state to the closed state has been sent to the MOSFET 13A (S120: YES), the process proceeds to step S130.

In step S130, after a lapse of a predetermined time period from the transmission of the signal to the MOSFET 13A for shifting the MOSFET 13A from the open state to the closed state, the voltage detection circuit 22 measures the inter-terminal voltage Vin and stores the value as the voltage Va. The predetermined time period is set to be shorter than the time waited before the next transmission of a signal for shifting the MOSFET 13A from the closed state to the open state to the MOSFET 13A. Then, in step S140, the voltage detection circuit 22 measures the intermediate voltage V½ and stores the value as the voltage Vc.

In step S150, it is determined whether or not the difference obtained by subtracting the voltage Va from the voltage Vb is smaller than a first predetermined value. The first predetermined value is a value provided to determine whether or not a change has occurred in the inter-terminal voltage Vin, and more specifically, it is set to be smaller than the amount of change in the inter-terminal voltage Vin that is expected to occur by shifting the MOSFET 13A from the open state to the closed state. When it is determined that the difference obtained by subtracting the voltage Va from the voltage Vb is smaller than the first predetermined value (S150: YES), the process proceeds to step S180. In step S180, it is determined that an open failure has occurred in the MOSFET 13A, a flag 1 is set to ON, and the process proceeds to step S350.

Figure 3:
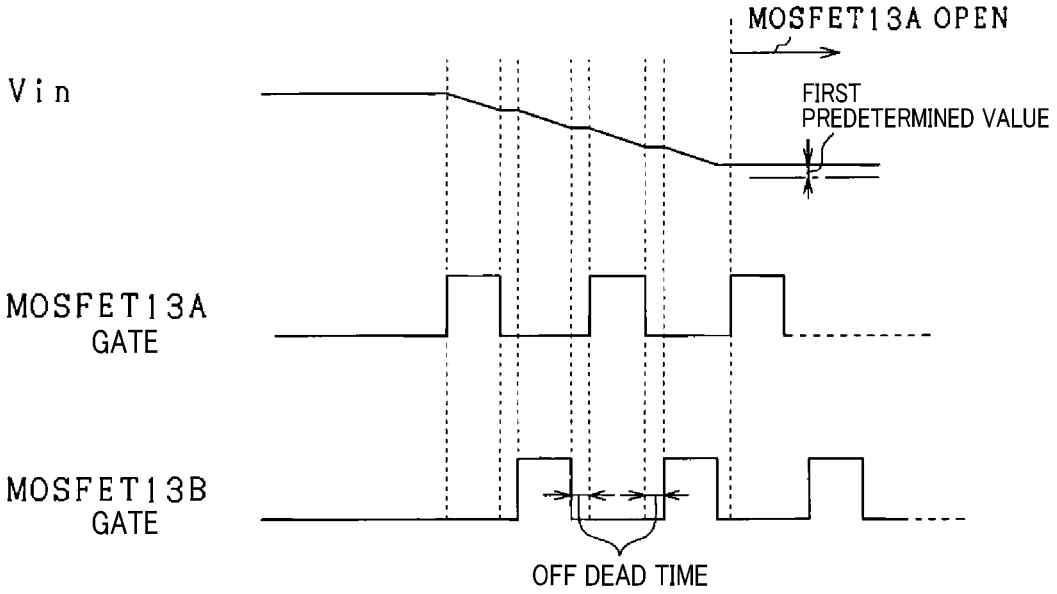
FIG. 3 is a graph showing a fluctuation of the inter-terminal voltage expected to occur when the MOSFET fails.

In the case where an open failure has occurred in the MOSFET 13A, the MOSFET 13A will not close even if a signal is output to switch the MOSFET 13A from the open state to the closed state. In this case, since the capacitor 14A does not release the accumulated charge, there will be no change in the inter-terminal voltage Vin as shown in FIG. 3. Therefore, when the difference between the inter-terminal voltages Vm before and after outputting to the MOSFET 13A a signal for switching the MOSFET 13A from the open state to the closed state is smaller than the first predetermined value, it can be judged that an open failure has occurred in the MOSFET 13A. The same tendency can also be seen when an open failure occurs in the MOSFET 13B (see FIG. 4).

When it is determined that the difference obtained by subtracting the voltage Va from the voltage Vb is greater than the first predetermined value (S150: NO), the process proceeds to step S160. In step S160, it is determined whether or not the difference obtained by subtracting the half of the voltage Va from the voltage Vc is greater than a second predetermined value. The second predetermined value is set to be larger than the amount of change in the inter-terminal voltage Vm expected to occur by shifting the MOSFET 13A from the open state to the closed state, and smaller than the amount of change expected to occur when the intermediate voltage V½ has risen and reached the inter-terminal voltage Vin. When it is determined that the difference obtained by subtracting the half of the voltage Va from the voltage Vc is greater than the second predetermined value (S160: YES), the process proceeds to step S190. In step S190, it is determined that an open failure has occurred in the capacitor 14A, a flag 3 is set to ON, and the process proceeds to step S350.

Figure 5:
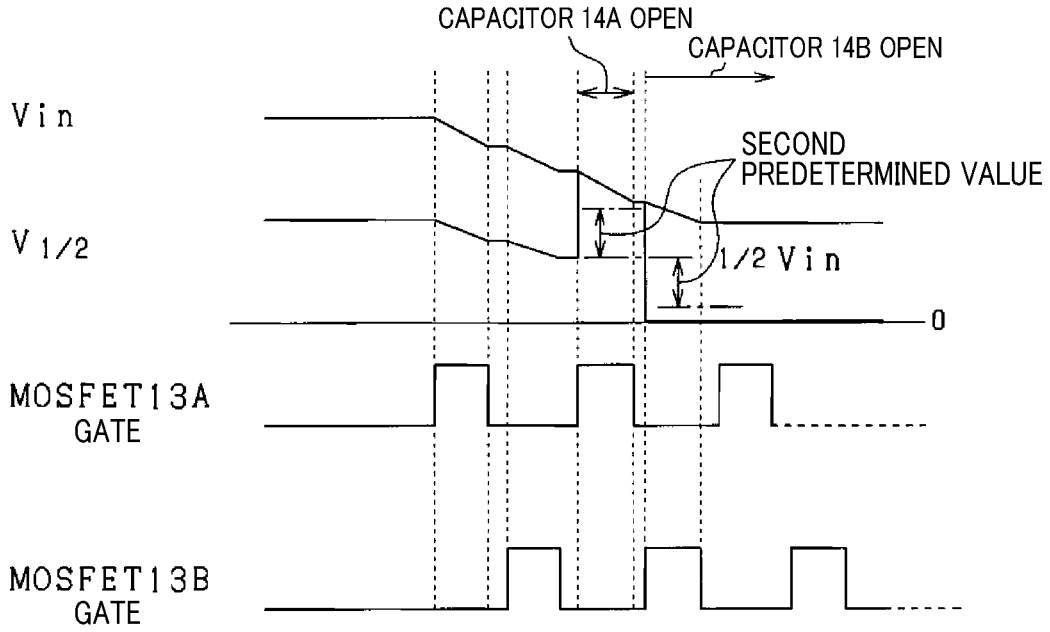
FIG. 5 is a graph showing the fluctuation of each voltage expected to occur when an open failure occurs in one of the capacitors.

When an open failure occurs in the capacitor 14A, no charge is accumulated in the capacitor 14A. Therefore, when the MOSFET 13A is switched from the open state to the closed state, a voltage which should normally be applied to the capacitor 14A is applied to the capacitor 14B via the relay 15A, the primary coil 19A, and the relay 15B. That is, by switching the MOSFET 13A from the open state to the closed state, the intermediate voltage V½ rises to a voltage value that is generally equal to the inter-terminal voltage Vin as shown in FIG. 5. Thus, when the difference obtained by subtracting the half of the voltage Va from the voltage Vc becomes greater than the second predetermined value by switching the MOSFET 13A from the open state to the closed state, it can be judged that an open failure has occurred in the capacitor 14A.

When it is determined that the difference obtained by subtracting the half of the voltage Va from the voltage Vc is smaller than the second predetermined value (S160: NO), the process proceeds to step S170. In step S170, it is determined whether or not the difference obtained by subtracting the voltage Va from the voltage Vb is greater than a third predetermined value. The third predetermined value is set as a value for determining whether or not the inter-terminal voltage Vin has decreased to the ground voltage. When it is determined that the difference obtained by subtracting the voltage Va from the voltage Vb is greater than the first predetermined value (S170: YES), the process proceeds to step S200. In step S200, it is determined that the short failure has occurred in the primary coil 19A, a flag 4 is set to ON, and the process proceeds to step S350.

Figure 4:
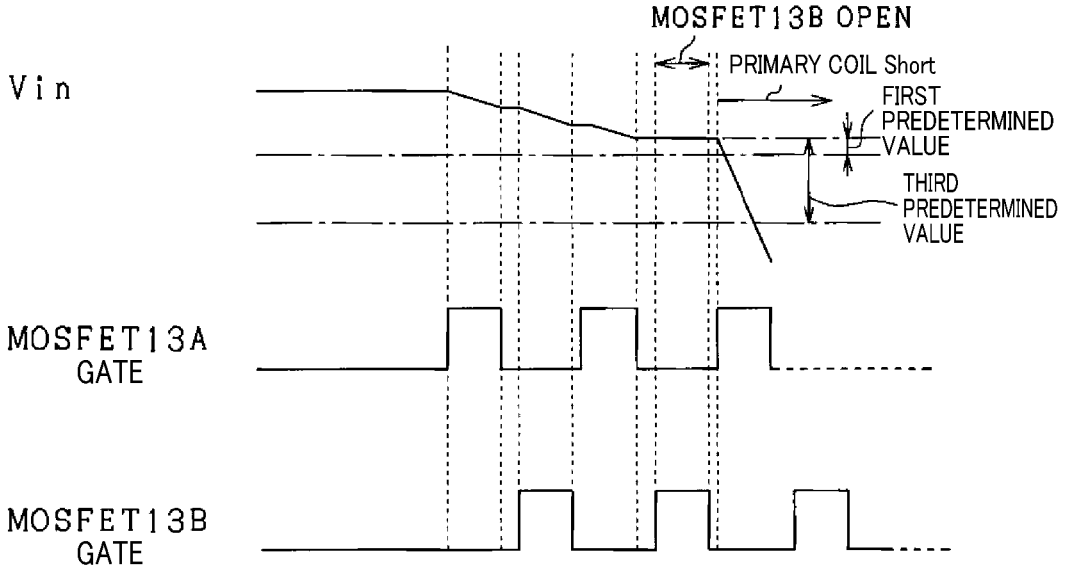
FIG. 4 is a graph showing a fluctuation of an inter-terminal voltage expected to occur when an open failure occurs in the MOSFET or a short failure occurs in a primary coil.

When the short failure occurs in the primary coil 19A, it becomes difficult to limit the current by the inductance of the primary coil 19A. Therefore, when the MOSFET 13A is switched from the open state to the closed state, as shown in FIG. 4, the inter-terminal voltage Vin decreases greatly beyond the third predetermined value. For the same reason, this is also the case when the MOSFET 13B is switched from the open state to the closed state. In such a case, it can be determined that the short-circuit failure has occurred in the primary coil 19A.

Further, when it is determined that a signal for shifting the MOSFET 13A from the open state to the closed state has not been sent to the MOSFET 13A (S120: NO), the process proceeds to step S210. In step S210, it is determined whether or not a signal for shifting the MOSFET 13B from the open state to the closed state is sent to the MOSFET 13B.

When it is determined that a signal for shifting the MOSFET 13B from the open state to the closed state has been sent to the MOSFET 13B (S210: YES), the process proceeds to step S220. Step S220 is a step that is in accordance with step S130, and specifically, the voltage detection circuit 22 measures the inter-terminal voltage Vin and stores the value as the voltage Vd. Step S230 is a step that is in accordance with step S140, and specifically, the voltage detection circuit 22 measures the intermediate voltage V½ and stores the value as the voltage Ve.

In step S240, it is determined whether or not the difference obtained by subtracting the voltage Vd from the voltage Vb is smaller than the first predetermined value. When it is determined that the difference obtained by subtracting the voltage Vd from the voltage Vb is smaller than the first predetermined value (S240: YES), the process proceeds to step S270. In step S270, it is determined that an open failure has occurred in the MOSFET 13B, a flag 2 is set to ON, and the process proceeds to step S350.

When it is determined that the difference obtained by subtracting the voltage Vd from the voltage Vb is greater than the first predetermined value (S240: NO), the process proceeds to step S250. In step S250, it is determined whether or not the difference obtained by subtracting the voltage Ve from the half of the voltage Vd is greater than the second predetermined value. The second predetermined value used at this time is set to be larger than the amount of change in the inter-terminal voltage Vin expected to occur by shifting the MOSFET 13B from the open state to the closed state, and smaller than the amount of change expected to occur when the intermediate voltage V½ has decreased to the ground voltage. When it is determined that the difference obtained by subtracting the voltage Ve from the half of the voltage Vd is greater than the second predetermined value (S250: YES), the process proceeds to step S280. In step S280, it is determined that an open failure has occurred in the capacitor 14B, a flag 3 is set to ON, and the process proceeds to step S350.

When an open failure occurs in the capacitor 14B, no charge is accumulated in the capacitor 14B. Therefore, when the MOSFET 13B is switched from the open state to the closed state, as shown in FIG. 5, the intermediate voltage V½ decreases to the ground voltage. Thus, when the difference obtained by subtracting the voltage Ve from the half of the voltage Vd becomes greater than the second predetermined value by switching the MOSFET 13B from the open state to the closed state, it can be judged that an open failure has occurred in the capacitor 14B.

When it is determined that the difference obtained by subtracting the voltage Ve from the half of the voltage Vd is smaller than the second predetermined value (S250: NO), the process proceeds to step S260. In step S260, it is determined whether or not the difference obtained by subtracting the voltage Vd from the voltage Vb is greater than the third predetermined value. When it is determined that the difference obtained by subtracting the voltage Vd from the voltage Vb is greater than the third predetermined value (S260: YES), the process proceeds to step S290. In step S290, it is determined that the short failure has occurred in the primary coil 19A, a flag 4 is set to ON, and the process proceeds to step S350.

Further, when it is determined that the present time is not within the discharge period (S110: NO), the process proceeds to step S300. In step S300, the voltage detection circuit 22 measures the intermediate voltage V½ and stores the value as the voltage Vf.

In step S310, it is determined whether or not the difference obtained by subtracting the half of the voltage Vb from the voltage Vf is greater than a fourth predetermined value. The fourth predetermined value is set to be larger than the first predetermined value and smaller than the second predetermined value. When it is determined that the difference obtained by subtracting the half of the voltage Vb from the voltage Vf is greater than the fourth predetermined value (S310: YES), the process proceeds to step S320. In step S320, it is determined that an open failure has occurred in one of the MOSFET 13A and the capacitor 14A, and a flag 3 is set to ON.

Figure 6:
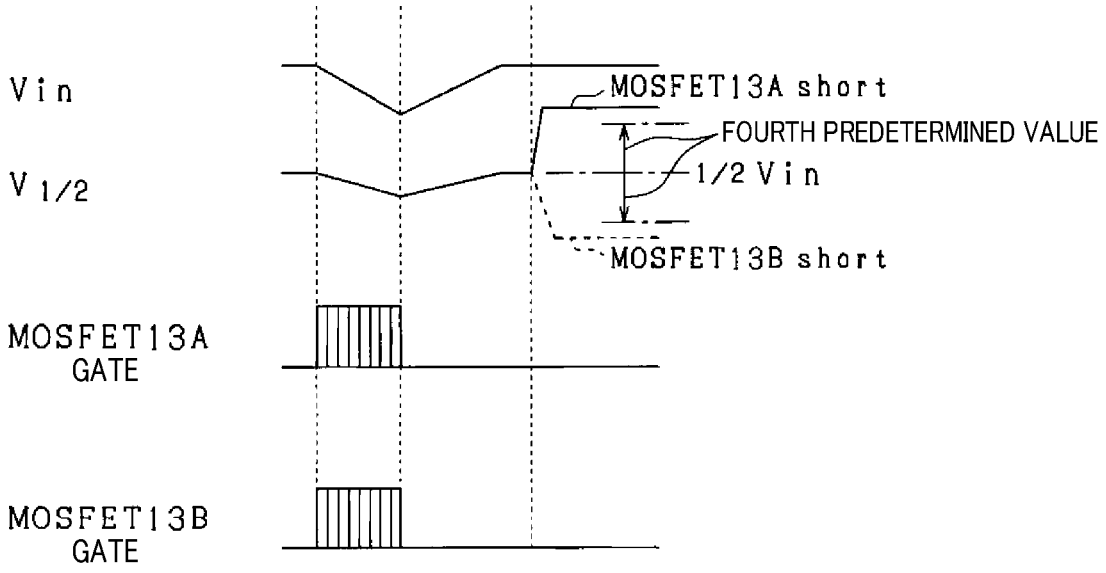
FIG. 6 is a graph showing the fluctuation of each voltage expected to occur when a short failure occurs in one of the MOSFETs.

When the short failure occurs in the MOSFET 13A, the DC-DC converter 12 will be connected to the capacitor 14B via the MOSFET 13A, the relay 15A, and the primary coil 19A. Thus, the electric charge supplied from the DC-DC converter 12 flows not only to the capacitor 14A but also to the capacitor 14B. In this case, as shown in FIG. 6, during the period in which the spark plug 30 does not generate discharge, the intermediate voltage V½ becomes higher than the half of the inter-terminal voltage Vin. However, it does not become so high as to match the inter-terminal voltage Vin.

Figure 7:
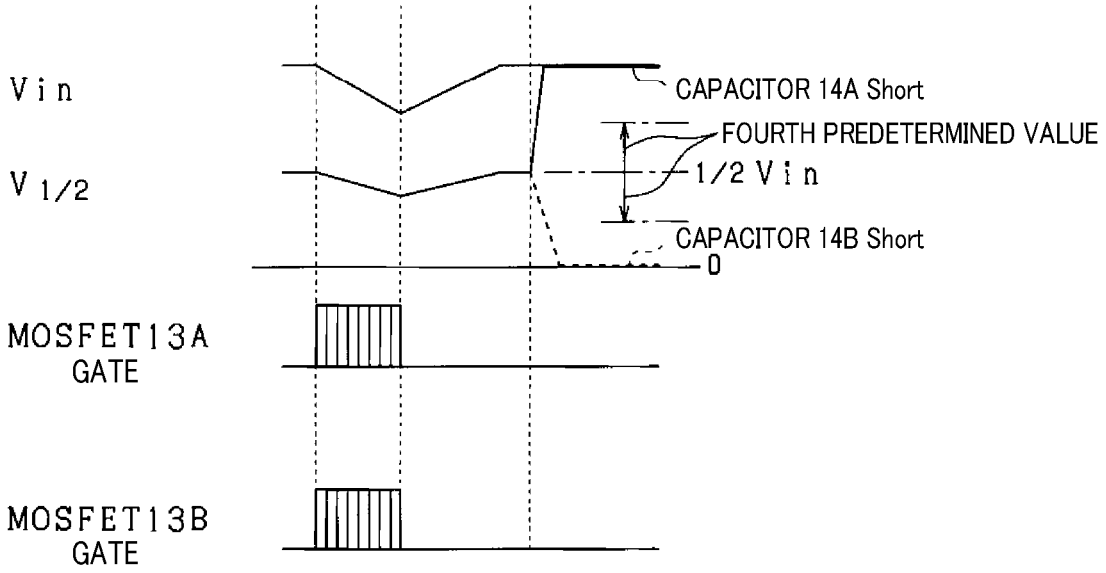
FIG. 7 is a graph showing the fluctuation of each voltage expected to occur when a short failure occurs in one of the capacitors.

Alternatively, when the short-circuit failure occurs in the capacitor 14A, the total voltage applied to the capacitor 14A and the capacitor 14B will be applied to the capacitor 14B. Thus, as shown in FIG. 7, the intermediate voltage V½ will be substantially equal to the total voltage applied to the capacitor 14A and the capacitor 14B.

Step S310 carries out the determination without distinguishing a short-circuit failure in the MOSFET 13A and a short-circuit failure in the capacitor 14A. Therefore, the fourth predetermined value is set based on the short-circuit failure in the MOSFET 13A, which is expected to have a smaller amount of change in the intermediate voltage V½ as compared with the short-circuit failure in the capacitor 14A.

Thus, when it is determined that the difference obtained by subtracting the half of the voltage Vb from the voltage Vf is larger than the fourth predetermined value in the period in which the spark plug 30 does not generate discharge, it can be judged that the short-circuit failure has occurred in one of the MOSFET 13A and the capacitor 14A.

When it is determined that the difference obtained by subtracting the half of the voltage Vb from the voltage Vf is smaller than the fourth predetermined value (S310: NO), the process proceeds to step S320. In step S320, it is determined whether or not the difference obtained by subtracting the voltage Vf from the half of the voltage Vb is greater than the fourth predetermined value. When it is determined that the difference obtained by subtracting the voltage Vf from the half of the voltage Vb is greater than the fourth predetermined value (S320: YES), the process proceeds to step S340. In step S340, it is determined that the short failure has occurred in one of the MOSFET 13B and the capacitor 14B, the flag 3 is set to ON, and the process proceeds to step S350.

When the short-circuit failure occurs in the MOSFET 13B, the capacitor 14B will be connected to the ground through the primary coil 19A and the MOSFET 13B, and therefore, as shown in FIG. 6, the intermediate voltage V½ becomes smaller than the half of the inter-terminal voltage Vin.

Alternatively, when the short-circuit failure occurs in the capacitor 14B, the connection point 17B of the capacitor 14A and the capacitor 14B will be connected to the ground. Thus, as shown in FIG. 7, the intermediate voltage V½ will be substantially equal to the ground voltage.

Step S320 carries out the determination without distinguishing a short-circuit failure in the MOSFET 13B and a short-circuit failure in the capacitor 14B. Therefore, in accordance with step S310, the fourth predetermined value is set based on the short-circuit failure in the MOSFET 13B, which is expected to have a smaller amount of change in the intermediate voltage V½ as compared with the short-circuit failure in the capacitor 14B.

Thus, when it is determined that the difference obtained by subtracting the voltage Vf from the half of the voltage Vb is larger than the fourth predetermined value in the period in which the spark plug 30 does not generate discharge, it can be judged that the short-circuit failure has occurred in one of the MOSFET 13B and the capacitor 14B.

Further, when it is determined that the difference obtained by subtracting the voltage Va from the voltage Vb is smaller than the first predetermined value (S170: NO), or when it is determined that a signal for shifting the MOSFET 13B from the open state to the closed state has not been sent to the MOSFET 13B (S210: NO), or when it is determined that the difference obtained by subtracting the voltage Vd from the voltage Vb is smaller than the third predetermined value (S260: NO), or when it is determined that the difference obtained by subtracting the voltage Vf from the half of the voltage Vb is smaller than the fourth predetermined value (S320: NO), the process proceeds to step S350.

In step S350, it is determined whether or not the flag 4 has been set to ON. When it is determined that the flag 4 has not been set to ON (S350: NO), the process proceeds to step S360. In step S360, it is determined whether or not the flag 1 has been set to ON. When it is determined that the flag 1 has not been set to ON (S360: NO), the process proceeds to step S370. In step S370, it is determined whether or not the flag 2 has been set to ON. When it is determined that the flag 2 has not been set to ON (S370: NO), the process proceeds to step S380. In step S380, it is determined whether or not the flag 3 has been set to ON. When it is determined that the flag 3 has not been set to ON (S380: NO), the present process terminates.

When it is determined that the flag 3 has been set to ON (S380: YES), the process proceeds to step S390 to switch to the emergency circuit and perform the full transistor operation, and then the present process terminates.

When it is determined that the flag 1 has been set to ON (S360: YES), the process proceeds to step S400. Step S400 is a step in accordance with step S370, and specifically, it is determined whether or not the flag 2 has been set to ON. When it is determined that the flag 2 is set to ON (S400: YES) or when it is determined that the flag 4 is set to ON (S350: YES), the process proceeds to step S420 to perform the reduced cylinder operation, and then the present control ends.

When both of the flags 1 and 2 are set to ON, this indicates that there was no change in the inter-terminal voltage Vin whether the MOSFET 13A was switched from the open state to the closed state or the MOSFET 13B was switched from the open state to the closed state. In this case, besides the possibility of both the MOSFETs 13A and 13B having open faults, it is possible that, in the first place, an open fault has occurred in the primary coil 19A, and no primary current flows from the capacitors 14A and 14B to the primary coil 19A. If the primary coil 19A is having an open failure, as described above, it can be predicted that no charge can be stored in the primary coil 19A, and it becomes difficult to generate an induced voltage at the secondary coil 19C. Therefore, when both the flags 1 and 2 are set to ON, it is appropriate to carry out the reduced cylinder operation.

When it is determined that the flag 1 is not set to ON but the flag 2 is set to ON (S370: YES), or when it is determined that the flag 1 is set to ON but the flag 2 is not set to ON (S400: NO), the process proceeds to step S410 to perform the full transistor operation using the normal MOSFET, and then the present control ends.

According to the above configuration, the present embodiment has the following effects.

It is possible to determine the fault location of the ignition circuit 10 based on at least one of the inter-terminal voltage Vm and the intermediate voltage V½. Further, it is possible to simplify the ignition circuit 10 as compared with a device that performs failure determination of the ignition circuit 10 based on the currents flowing through the MOSFET 13A and the MOSFET 13B.

During the discharge period of the spark plug 30, the MOSFET 13A and the MOSFET 13B open and close complementarily. As a result, the primary current is supplied complementarily from the MOSFET 13A and the MOSFET 13B, whereby the inter-terminal voltage Vin and the intermediate voltage V½ fluctuate. When the fluctuation is different from what is expected, it is possible to determine the fault location of the ignition circuit 10 based on at least one of the inter-terminal voltage Vin and the intermediate voltage V½.

When the ignition circuit 10 is operating normally, the intermediate voltage V½ has a constant value as the half of the inter-terminal voltage Vm during the non-discharge period of the spark plug 30 in which the MOSFET 13A and the MOSFET 13B do not open and close complementarily. Therefore, when the intermediate voltage V½ does not have a constant value as the half of the inter-terminal voltage Vin, it can be judged that a fault has occurred in one of the components of the ignition circuit 10. Further, according to this failure determination, it is possible to determine a failure that is difficult to determine during the discharge period of the spark plug 30.

When a fault occurs that results in the flag 3 to be turned ON, the circuit is switched to the emergency circuit and the full transistor operation is performed. This makes it possible to supply the primary current to the primary coil 19A by using another path without passing through the MOSFET series connection 13 and the capacitor series connection 14, including the location determined to be faulty. That is, it is possible to control directly the supply and cutoff of the electric charge from the DC-DC converter 12 to the primary coil 19A by the opening and closing operation of the MOSFET 18, and thus cause the spark plug 30 to generate discharge.

The above embodiment may be modified as follows.

In the above embodiment, the frequency of the open/close signal transmitted to the MOSFETs 13A and 13B is adjusted to the resonance frequency. This need not be necessarily adjusted to the resonance frequency.

In the above embodiments, the voltage supplied to the primary coil 19A is a voltage obtained by boosting the voltage of the battery 11 by the DC-DC converter 12. Instead, the battery may be changed to a high voltage battery such as those used in a hybrid car or the like. In this case, the high voltage battery corresponds to the charge supply unit. According to this configuration, boosting by the DC-DC converter 12 becomes unnecessary, and the configuration can be further simplified.

In the above embodiment, the MOSFETs 13A and 13B are used as the switching elements for controlling the conduction and interruption of the primary current supplied to the primary coil 19 A. Instead, they may be changed to a power transistor, thyristor, TRIAC, or the like.

In the above embodiment, the inter-terminal voltage Vin before switching the MOSFET 13A from the open state to the closed state (corresponding to the voltage Vb) and the inter-terminal voltage Vin after that (corresponding to the voltage Va) are measured during the discharge period to be used for failure determination. The measurement of the voltage Vb and the voltage Va is not limited to the above method. As shown in FIG. 3, when the MOSFETs 13A and 13B are driven to open and close complementarily, there is a period during which both MOSFETs are in the open state (hereinafter referred to as "OFF dead time"). In this alternative example, the inter-terminal voltage Vin measured during an OFF dead time that is a period after switching the MOSFET 13B from the closed state to the open state and before switching the MOSFET 13A from the open state to the closed state is stored as the voltage Vb. After storing the voltage Vb, the inter-terminal voltage Vin measured during an OFF dead time that is a period after switching the MOSFET 13A from the closed state to the open state and before switching the MOSFET 13B from the open state to the closed state is stored as the voltage Va. Using the thus stored voltage Vb and voltage Va, it is possible to accurately calculate how much the inter-terminal voltage Vin has changed in the period in which the MOSFET 13A is in the closed state, and thus, a more accurate failure determination can be performed.

The intermediate voltage V½ (corresponding to the voltage Vc) is measured similarly, that is, the intermediate voltage V½ measured during an OFF dead time that is a period after switching the MOSFET 13A from the open state to the closed state and before switching the MOSFET 13B from the open state to the closed state is stored as the voltage Vc.

The measurement of the voltage Vb and the voltage Vd in the case where the MOSFET 13B is switched from the open state to the closed state can also be performed in accordance with the above alternative example, in the measurement method described below. The inter-terminal voltage Vin measured during an OFF dead time that is a period after switching the MOSFET 13A from the closed state to the open state and before switching the MOSFET 13B from the open state to the closed state is stored as the voltage Vb. After storing the voltage Vb, the inter-terminal voltage Vin measured during an OFF dead time that is a period after switching the MOSFET 13B from the closed state to the open state and before switching the MOSFET 13A from the open state to the closed state is stored as the voltage Vd. The intermediate voltage V½ (corresponding to the voltage Ve) is measured similarly, that is, the intermediate voltage V½ measured during an OFF dead time that is a period after switching the MOSFET 13B from the open state to the closed state and before switching the MOSFET 13A from the open state to the closed state is stored as the voltage Ve.

In the above embodiment, when it is determined that the short-circuit failure has occurred in one of the MOSFETs 13A and 13B, the circuit is switched to the emergency circuit and the full transistor operation is performed. Alternatively, the normally operating MOSFET may be used to carry out the full transistor operation.

In the above embodiment, when it is determined that an open failure has occurred in one of the MOSFETs 13A and 13B, the normally operating MOSFET is used to carry out the full transistor operation. Alternatively, it is also possible to switch to the emergency circuit to carry out the full transistor operation.

In the above embodiment, the reduced cylinder operation is performed in the case of a failure related to the primary coil 19A. Alternatively, the reduced cylinder operation may be performed when a failure occurs in any of the components necessary for causing the spark plug 30 to generate discharge, including a failure related to the primary coil 19A. Thus, the relay 15A, the relay 15B, the current path 16A, and the current path 16D having the MOSFET 18, which are necessary for forming the emergency circuit, are not necessarily required for forming the ignition circuit 10.

[Alternative Example 1] In the above embodiment, an open failure determination of the capacitor 14A is performed using the second predetermined value, or the short failure determination of the capacitor 14A is performed using the fourth predetermined value. With respect to this, instead of the above determination, as described below, it is also possible to compare a first threshold value, which is provided to determine whether or not the voltage value is substantially equal to the inter-terminal voltage Vin, with the intermediate voltage V½.

In a state where an open failure has occurred in the capacitor 14A, when the MOSFET 13A is switched from the open state to the closed state, a voltage which should normally be applied to the capacitor 14A is applied to the capacitor 14B via the primary coil 19A. Thus, as shown in FIG. 5, the intermediate voltage V½ will be substantially equal to the inter-terminal voltage Vin. Thus, when the intermediate voltage V½ exceeds the first threshold value by switching the MOSFET 13A from the open state to the closed state, it can be judged that an open failure has occurred in the capacitor 14A.

When the short-circuit failure occurs in the capacitor 14A, the total voltage applied to the capacitor 14A and the capacitor 14B will be applied to the capacitor 14B. Thus, as shown in FIG. 7, the intermediate voltage V½ will be substantially equal to the total voltage applied to the capacitor 14A and the capacitor 14B. Thus, when the intermediate voltage V½ exceeds the first threshold value in the period in which the spark plug 30 does not generate discharge, it can be judged that the short failure has occurred in the capacitor 14A.

In the above embodiment, the failure determination is performed without distinguishing between the short-circuit failure of the MOSFET 13A and the short-circuit failure of the capacitor 14A (step S310 in FIG. 2). With respect to this, using the determination method described in [Alternative Example 1], it is possible to perform failure determination distinguishing between the short failure of the MOSFET 13A and the short failure of the capacitor 14A.

To be specific, when the intermediate voltage V½ exceeds the first threshold value in the period in which the spark plug 30 does not generate discharge, it can be judged that the short failure has occurred in the capacitor 14A. On the other hand, when it is determined that the intermediate voltage V½ is smaller than the first threshold value and the difference obtained by subtracting the half of the inter-terminal voltage Vin from the intermediate voltage V½ is larger than the fourth predetermined value in the period in which the spark plug 30 does not generate discharge, it can be judged that the short-circuit failure has occurred in the MOSFET 13A.

[Alternative Example 2] In the above embodiment, an open failure determination of the capacitor 14B is performed using the second predetermined value, or the short failure determination of the capacitor 14B is performed using the fourth predetermined value. With respect to this, instead of the above determination, as described below, it is also possible to compare a second threshold value, which is provided to determine whether or not the voltage value is substantially equal to the ground voltage, with the intermediate voltage V½.

When an open failure occurs in the capacitor 14B, no charge is accumulated in the capacitor 14B. Therefore, when the MOSFET 13B is switched from the open state to the closed state, the intermediate voltage V½ decreases to the ground voltage. Thus, when the intermediate voltage V½ becomes smaller than the second threshold value by switching the MOSFET 13B from the open state to the closed state, it can be judged that an open failure has occurred in the capacitor 14B.

In the case where the short-circuit failure occurs in the capacitor 14B, the connection point 17B of the capacitor 14A and the capacitor 14B will be connected to the ground. Thus, the intermediate voltage V½ will be substantially equal to the ground voltage. Thus, when the intermediate voltage V½ becomes smaller than the second threshold value in the period in which the spark plug 30 does not generate discharge, it can be judged that the short failure has occurred in the capacitor 14B.

In the above embodiment, the failure determination is performed without distinguishing between the short-circuit failure of the MOSFET 13B and the short-circuit failure of the capacitor 14B (step S320 in FIG. 2). With respect to this, using the determination method described in [Alternative Example 2], it is possible to perform failure determination distinguishing between the short failure of the MOSFET 13B and the short failure of the capacitor 14B.

To be specific, when the intermediate voltage V½ becomes smaller than the second threshold value in the period in which the spark plug 30 does not generate discharge, it can be judged that the short failure has occurred in the capacitor 14B. On the other hand, when it is determined that the intermediate voltage V½ exceeds the second threshold value and the difference obtained by subtracting the intermediate voltage V½ from the half of the inter-terminal voltage Vin is larger than the fourth predetermined value in the period in which the spark plug 30 does not generate discharge, it can be judged that the short-circuit failure has occurred in the MOSFET 13B.

Although the present disclosure is described based on examples, it should be understood that the present disclosure is not limited to the examples and structures. The present disclosure encompasses various modifications and variations within the scope of equivalence. In addition, the scope of the present disclosure and the spirit include other combinations and embodiments which may include only one component thereof, or more or less than one component thereof.

What is claimed is:

1. A failure diagnosis device for an ignition circuit, comprising:

an ignition plug for generating discharge to ignite a combustible fuel-air mixture;

an ignition coil including a primary coil and a secondary coil, the ignition coil causing the ignition plug connected to the secondary coil to generate the discharge by voltage induction of the primary coil;

a capacitor series connection including a high side capacitor connected to a charge supply unit, and a low side capacitor connected in series to the high side capacitor;

a switching-element series connection including a high side switching element and a low side switching element the switching-element series connection being connected in parallel with the capacitor series connection, a connection point of the high side switching element and the low side switching element being connected to a connection point of the high side capacitor and the low side capacitor via the primary coil, and the high side switching element and the low side switching element being configured to complementarily open and close;

an inter-terminal voltage detection unit for detecting an inter-terminal voltage of the capacitor series connection;

an intermediate voltage detection unit for detecting an intermediate voltage which is a voltage at the connection point of the high side capacitor and the low side capacitor; and a determination unit for determining a failure location of the ignition circuit based on at least one of the inter-terminal voltage detected by the inter-terminal voltage detection unit and the intermediate voltage detected by the intermediate voltage detection unit.

2. The failure diagnosis device for an ignition circuit according to claim 1, wherein the determination unit determines the failure location of the ignition circuit based on at least one of the inter-terminal voltage and the intermediate voltage, during a discharge period of the ignition plug in which the high side switching element and the low side switching element are complementarily opened and closed.

3. The failure diagnosis device for an ignition circuit according to claim 2, wherein the determination unit determines that an open failure has occurred in the high side switching element, when an amount of change between the inter-terminal voltages before and after outputting the signal is smaller than a first predetermined value, regardless of signal output to the high side switching element which is output to switch from an open state to a closed state.

4. The failure diagnosis device for an ignition circuit according to claim 2, wherein the determination unit determines that an open failure has occurred in the low side switching element, when an amount of change between the inter-terminal voltages before and after outputting the signal is smaller than a first predetermined value, regardless of outputting a signal to switch the low side switching element from an open state to a closed state.

5. The failure diagnosis device for an ignition circuit according to claim 2, wherein the determination unit determines that an open failure has occurred in the primary coil when an amount of change between the inter-terminal voltages before and after the opening and closing is smaller than a first predetermined value, regardless of the high side switching element and the low side switching element being complementarily opened and closed.

6. The failure diagnosis device for an ignition circuit according to claim 2, wherein the determination unit determines that a short failure has occurred in the primary coil, when an amount of change between the inter-terminal voltages before and after the switching becomes greater than a third predetermined value by switching the high side switching element or the low side switching element from an open state to a closed state.

7. The failure diagnosis device for an ignition circuit according to claim 2, wherein the determination unit determines that an open failure has occurred in the high side capacitor, when by switching the high side switching element from an open state to a closed state, an amount of change between the intermediate voltages before and after the switching becomes greater than a second predetermined value.

8. The failure diagnosis device for an ignition circuit according to claim 2, wherein the determination unit determines that an open failure has occurred in the low side capacitor when, by switching the low side switching element from an open state to a closed state, an amount of change between the intermediate voltages before and after the switching becomes greater than a second predetermined value.

9. The failure diagnosis device for an ignition circuit according to claim 1, wherein a capacitance of the high side capacitor is equal to a capacitance of the low side capacitor, and the determination unit determines the failure location of the ignition circuit based on the intermediate voltage, during a non-discharge period of the ignition plug in which the high side switching element and the low side switching element are not complementarily opened and closed.

10. The failure diagnosis device for an ignition circuit according to claim 9, wherein the determination unit determines that a short failure has occurred in the high side switching element when the intermediate voltage becomes greater than a fourth predetermined value in relation to a voltage value that is half of the inter-terminal voltage.

11. The failure diagnosis device for an ignition circuit according to claim 9, wherein the determination unit determines that a short failure has occurred in the low side switching element when the intermediate voltage becomes smaller than a fourth predetermined value with respect to a voltage value that is half of the inter-terminal voltage.

12. The failure diagnosis device for an ignition circuit according to claim 9, wherein the determination unit determines that a short failure has occurred in the high side capacitor when the intermediate voltage becomes greater than a first threshold which is provided to determine whether or not a voltage value is substantially equal to the inter-terminal voltage.

13. The failure diagnosis device for an ignition circuit according to claim 9, wherein the determination unit determines that a short failure has occurred in the low side capacitor when the intermediate voltage becomes smaller than a second threshold which is provided to determine whether or not a voltage value is substantially equal to a ground voltage.

14. The failure diagnosis device for an ignition circuit according to claim 1, further comprising a first path switching unit for switching between a first state in which a connection point of the high side switching element and the low side switching element is connected to a first end of the primary coil, and a second state in which a connection point of the charge supply unit and the capacitor series connection is connected to the first end of the primary coil, and a second path switching unit for switching between a third state in which a second end of the primary coil is connected to a connection point of the high side capacitor and the low side capacitor, and a fourth state in which the second end of the primary coil is connected to ground via a third switching element, wherein the determination unit causes the first path switching unit to switch to the first state and causes the second path switching unit to switch to the third state when it is determined that a failure has not occurred in the ignition circuit, and in contrast, the determination unit causes the first path switching unit to switch to second state, and the second path switching unit to switch to the fourth state when a failure location of the ignition circuit other than a failure of the primary coil is determined.

15. The failure diagnosis device for an ignition circuit according to claim 3, wherein the determination unit determines that an open failure has occurred in the low side switching element, when an amount of change between the inter-terminal voltages before and after outputting the signal is smaller than the first predetermined value, regardless of outputting a signal to switch the low side switching element from an open state to a closed state.

16. The failure diagnosis device for an ignition circuit according to claim 3, wherein the determination unit determines that an open failure has occurred in the primary coil when an amount of change between the inter-terminal voltages before and after the opening and closing is smaller than the first predetermined value, regardless of the high side switching element and the low side switching element being complementarily opened and closed.

17. The failure diagnosis device for an ignition circuit according to claim 3, wherein the determination unit determines that a short failure has occurred in the primary coil, when an amount of change between the inter-terminal voltages before and after the switching becomes greater than a third predetermined value by switching the high side switching element or the low side switching element from an open state to a closed state.

18. The failure diagnosis device for an ignition circuit according to claim 3, wherein the determination unit determines that an open failure has occurred in the high side capacitor, when by switching the high side switching element from an open state to a closed state, an amount of change between the intermediate voltages before and after the switching becomes greater than a second predetermined value.

19. The failure diagnosis device for an ignition circuit according to claim 3, wherein the determination unit determines that an open failure has occurred in the low side capacitor when, by switching the low side switching element from an open state to a closed state, an amount of change between the intermediate voltages before and after the switching becomes greater than a second predetermined value.

20. The failure diagnosis device for an ignition circuit according to claim 4, wherein a capacitance of the high side capacitor is equal to a capacitance of the low side capacitor, and the determination unit determines the failure location of the ignition circuit based on the intermediate voltage, during a non-discharge period of the ignition plug in which the high side switching element and the low side switching element are not complementarily opened and closed.

* * * * *